US011986878B2

(12) United States Patent
Noguchi et al.

(10) Patent No.: US 11,986,878 B2
(45) Date of Patent: May 21, 2024

(54) DIE MOLDING SURFACE TREATMENT DEVICE

(71) Applicants: Sintokogio, Ltd., Nagoya (JP); Toyota Jidosha Kabushiki Kaisha, Toyota (JP)

(72) Inventors: Youhei Noguchi, Toyokawa (JP); Koji Sakou, Toyokawa (JP); Hirotaka Kurita, Toyokawa (JP); Takashi Nagaya, Toyokawa (JP); Hirotsune Watanabe, Miyoshi (JP); Katsutoshi Okumura, Toyota (JP)

(73) Assignees: Sintokogio, Ltd., Nagoya (JP); Toyota Jidosha Kabushiki Kaisha, Toyota (JP)

( * ) Notice: Subject to any disclaimer, the term of this patent is extended or adjusted under 35 U.S.C. 154(b) by 552 days.

(21) Appl. No.: 17/258,635

(22) PCT Filed: Apr. 24, 2019

(86) PCT No.: PCT/JP2019/017446
§ 371 (c)(1),
(2) Date: Jan. 7, 2021

(87) PCT Pub. No.: WO2020/012758
PCT Pub. Date: Jan. 16, 2020

(65) Prior Publication Data

US 2021/0268572 A1 Sep. 2, 2021

(30) Foreign Application Priority Data

Jul. 10, 2018 (JP) ..... 2018-131031

(51) Int. Cl.
*B22C 23/02* (2006.01)
*B22C 9/20* (2006.01)
*B22D 43/00* (2006.01)

(52) U.S. Cl.
CPC ..... *B22C 23/02* (2013.01); *B22C 9/20* (2013.01); *B22D 43/007* (2013.01)

(58) Field of Classification Search
USPC ..... 118/313–316, 62, 63, 323, 317, 302; 134/198, 199; 15/106, 111, 114, 117
See application file for complete search history.

(56) References Cited

U.S. PATENT DOCUMENTS

2008/0289141 A1* 11/2008 Oh ..... A47L 9/04 15/354
2019/0116729 A1* 4/2019 Skoog ..... A01D 43/063

FOREIGN PATENT DOCUMENTS

CN 205868973 U * 1/2017
CN 205868973 U 1/2017
(Continued)

OTHER PUBLICATIONS

English Translation WO8-8601442A1 (Year: 1985).*
(Continued)

*Primary Examiner* — Yewebdar T Tadesse
(74) *Attorney, Agent, or Firm* — Taft Stettinius & Hollister LLP

(57) ABSTRACT

When molding surfaces (50A) of a pair of dies (50) are to be cleaned by air-blowing, air is blown towards the molding surfaces (50A) from blowing nozzles (22A) of a cleaning blowing function portion (22) while a moving body (16) is reciprocatingly moved by driving force of a driving mechanism (18). When a parting agent is to be applied to the molding surfaces (50A) of the pair of dies (50), the mold release agent is jetted out towards the molding surfaces (50A) from spraying nozzles (24A) of a parting agent application function portion (24) while the moving body (16) is reciprocatingly moved by the driving force of the driving mechanism (18). In both of these situations, at the same time as the treatment of the molding surfaces (50A), a
(Continued)

cleaning brush (32) reciprocatingly moves together with the moving body (16) and sweeps a device floor surface (12).

6 Claims, 3 Drawing Sheets

(56) References Cited

FOREIGN PATENT DOCUMENTS

| | | | | |
|---|---|---|---|---|
| EP | 0340845 | A1 | 11/1989 | |
| EP | 1439004 | A2 * | 7/2004 | ..... B05B 15/0431 |
| JP | H7136599 | A | 5/1995 | |
| JP | H0818123 | B2 | 2/1996 | |
| JP | H08192258 | A | 7/1996 | |
| JP | 2010184279 | A | 8/2010 | |
| KR | 860001628 | A | 3/1986 | |
| WO | WO8601442 | A1 * | 7/2004 | ..... B05B 15/0431 |

OTHER PUBLICATIONS

English Abstract CN205868973U (Year: 2017).*

Chinese First Office Action, The State Intellectual Property Office of People's Republic of China, Chinese Application No. 201980040562.X, dated Dec. 24, 2021, 14 pages.

Chinese Second Office Action, The State Intellectual Property Office of People's Republic of China, Chinese Application No. 201980040562.X, dated Jul. 22, 2022, 6 pages.

International Search Report, Japan Patent Office, International Application No. PCT/JP2019/017446, dated Jul. 16, 2019, 2 pages.

Written Opinion of the International Searching Authority, Japan Patent Office, International Application No. PCT/JP2019/017446, dated Jul. 16, 2019, 3 pages.

Chinese Fourth Office Action, The State Intellectual Property Office of People's Republic of China, Chinese Application No. 201980040562.X, dated Nov. 28, 2023, 12 pages.

* cited by examiner

DIE MOLDING SURFACE TREATMENT DEVICE

CROSS-REFERENCE TO RELATED APPLICATIONS

This application is a U.S. National Phase Application of International Patent Application No. PCT/JP2019/017446, which was filed on Apr. 24, 2019, and which claims the benefit of, and priority to, Japanese Patent Application No. 2018-131031, which was filed on Jul. 10, 2018. The contents of each application are incorporated herein by reference in their entirety.

TECHNICAL FIELD

The present invention relates to a die molding surface treatment device.

BACKGROUND ART

Technologies that clean a molding surface of a die by air-blowing, technologies that apply a parting agent to a molding surface of a die, and suchlike are known (for example, see Japanese Patent Application Publication (JP-B) No. H8-018123).

SUMMARY OF INVENTION

Technical Problem

However, with these technologies, a device floor surface is soiled by waste matter that falls during air-blowing, during mold release agent application or the like. Accordingly, the device must be paused and the device floor surface must be cleaned by a separate process.

In consideration of the circumstances described above, an object of the present disclosure is to provide a die molding surface treatment device that, when waste matter falls onto a device floor surface while the device is being operated, may automatically perform cleaning while the device is operating.

Solution to Problem

A die molding surface treatment device according to a first aspect includes: a moving body including a portion that is disposed between a pair of dies that are arrayed in a horizontal direction, with molding surfaces of the dies opposing one another; a driving mechanism that reciprocatingly moves the moving body in a direction that is orthogonal to an opposing direction of the pair of dies in a device plan view; a treatment function portion provided at the moving body, the treatment function portion performing at least one of a treatment of air-blowing the molding surfaces of the pair of dies or a treatment of applying a parting agent to the molding surfaces of the pair of dies; and a cleaning implement attached to a lower portion of the moving body, the cleaning implement reciprocatingly moving together with the moving body and sweeping a device floor surface.

According to the die molding surface treatment device according to the first aspect, the moving body is structured with the portion that is disposed between the pair of dies, which are arranged in the horizontal direction with the molding surfaces opposing one another. The moving body is reciprocatingly moved by the driving mechanism in the direction that is orthogonal to the opposing direction of the pair of dies in the device plan view. The treatment function portion provided at the moving body performs one or both of the treatment of air-blowing the molding surfaces of the pair of dies and the treatment of applying a parting agent to the molding surfaces of the pair of dies. The cleaning implement is mounted at the lower portion of the moving body. The cleaning implement moves reciprocatingly together with the moving body and sweeps the device floor surface. Thus, when waste matter falls onto the device floor surface while the moving body is being reciprocatingly moved and the treatment function portion is treating the molding surfaces of the dies, the device floor surface is automatically cleaned by the cleaning implement.

In a die molding surface treatment device according to a second aspect, in the die molding surface treatment device according to the first aspect, the device floor surface is constituted from an ultra-high molecular weight polyethylene.

According to the die molding surface treatment device according to the second aspect, because the device floor surface is constituted from the ultra-high molecular weight polyethylene, waste matter is unlikely to stick to the device floor surface when the waste matter falls onto the device floor surface while the moving body is being moved reciprocatingly and the treatment function portion is treating the molding surfaces of the dies. Therefore, the waste matter may be excellently removed by the cleaning implement.

In a die molding surface treatment device according to a third aspect, in the die molding surface treatment device according to the first aspect or the second aspect, recovering means is provided in correspondence with positions at both ends of a reciprocating movement range of the cleaning implement, the recovering means recovering waste matter swept by the cleaning implement.

According to the die molding surface treatment device according to the third aspect, the waste matter swept by the cleaning implement is automatically recovered by the recovering means at both end sides of the reciprocating movement range of the cleaning implement. Therefore, waste matter swept by the cleaning implement may be recovered directly, and the waste matter does not remain on the device floor surface even though the waste matter is not recovered by a separate process.

In a die molding surface treatment device according to a fourth aspect, the die molding surface treatment device according to the third aspect further includes: a waste collector that serves as the recovering means; a level sensor provided at the waste collector, the level sensor detecting an accumulated height of waste matter recovered and accumulated at the waste collector; and a reporting means that, in a case in which a detection value of the level sensor is at least a pre-specified criterion value, reports that at least a predetermined amount of the waste matter has been accumulated.

According to the die molding surface treatment device according to the fourth aspect, the level sensor provided at the waste collector that serves as the recovering means detects an accumulated height of waste matter recovered and accumulated in the waste collector. When a value detected by the level sensor is at least the pre-specified criterion value, the reporting means reports that the waste matter has been accumulated to at least the predetermined amount.

In a die molding surface treatment device according to a fifth aspect, the die molding surface treatment device according to any one of the first to fourth aspects further includes a cleaning brush attached to an upper portion of the moving body, the cleaning brush reciprocatingly moving together with the moving body and sweeping an upward-facing surface of the dies.

According to the die molding surface treatment device according to the fifth aspect, when the moving body reciprocatingly moves, the cleaning brush sweeps the upward-facing surface of the die. Thus, the upward-facing surface of the die is cleaned. Waste matter that falls onto the device floor surface when the cleaning brush sweeps the upward-facing surface of the die is then swept by the cleaning implement.

In a die molding surface treatment device according to a sixth aspect, the die molding surface treatment device according to any one of the first to fifth aspects further includes shielding brushes provided at the moving body, base end sides of the shielding brushes being attached at both flank sides of the treatment function portion at sides of the treatment function portion that oppose the dies, and distal end sides of the shielding brushes being disposed spaced apart from but close to the dies in a state in which the shielding brushes oppose the dies, the shielding brushes suppressing scattering of flying matter that is produced during a treatment by the treatment function portion. The meaning of the term "both of flank sides" recited in the present aspect is intended to include sides at both flanks of the treatment function portion when a side of the treatment function portion that opposes the dies is seen in an elevation view.

According to the die molding surface treatment device according to the sixth aspect, the shielding brushes provided at the moving body are specified such that the base end sides of the shielding brushes are attached to the both flank sides of the treatment function portion that oppose the dies. In states in which the shielding brushes oppose the dies, the distal end sides of the shielding brushes are disposed proximate to the dies with space therebetween. Scattering of flying matter that is produced during a treatment by the treatment function portion is suppressed by these shielding brushes.

Advantageous Effects of Invention

As described above, according to the die molding surface treatment device according to the present disclosure, an excellent effect is provided in that, when waste matter falls onto a device floor surface while the device is being operated, the waste matter may be automatically cleaned up while the device is operating.

DETAILED DESCRIPTION

Figure 1:
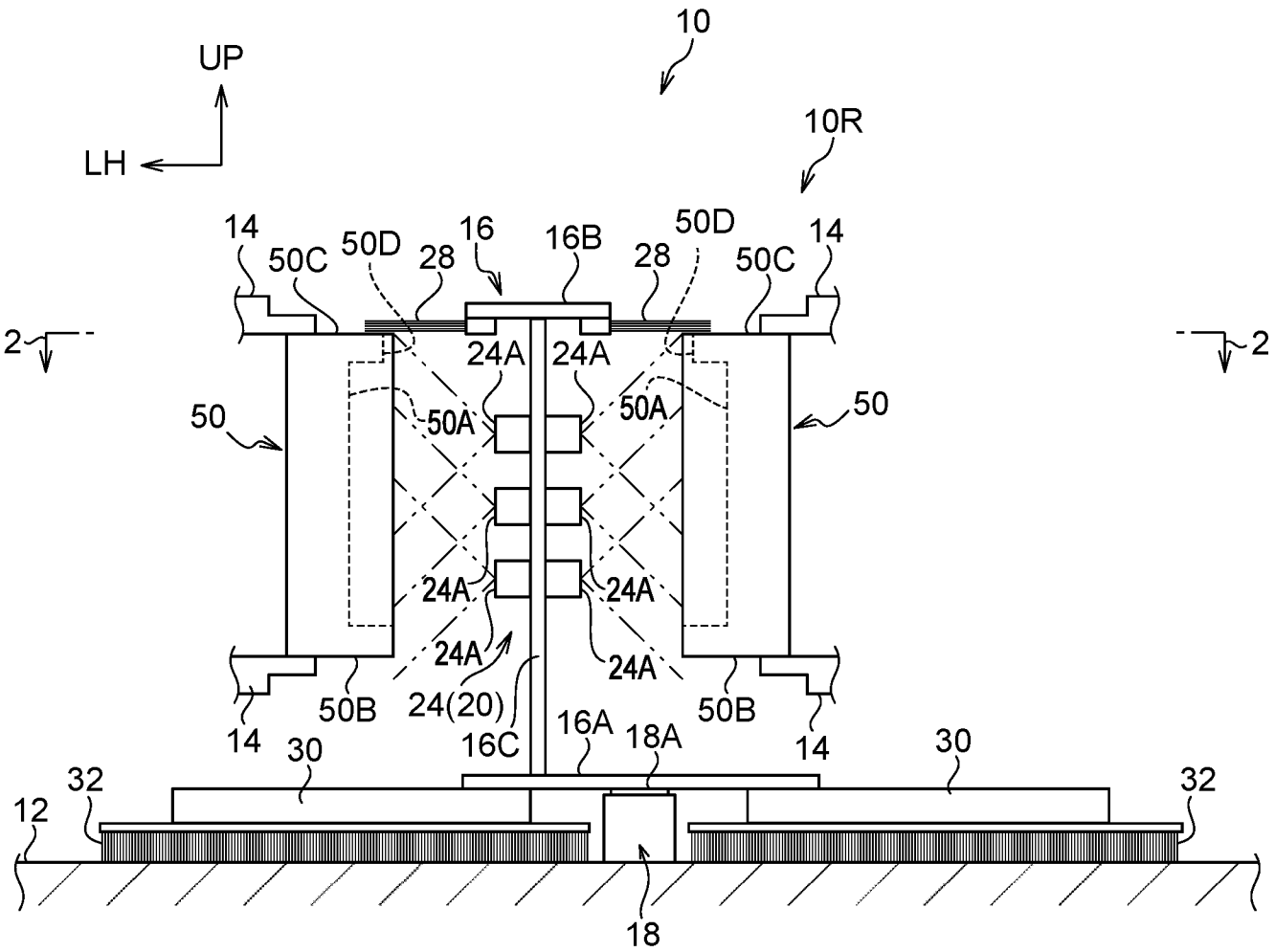
FIG. 1 is a schematic elevation view showing a parting agent application device according to an exemplary embodiment of the present disclosure.
Figure 2:
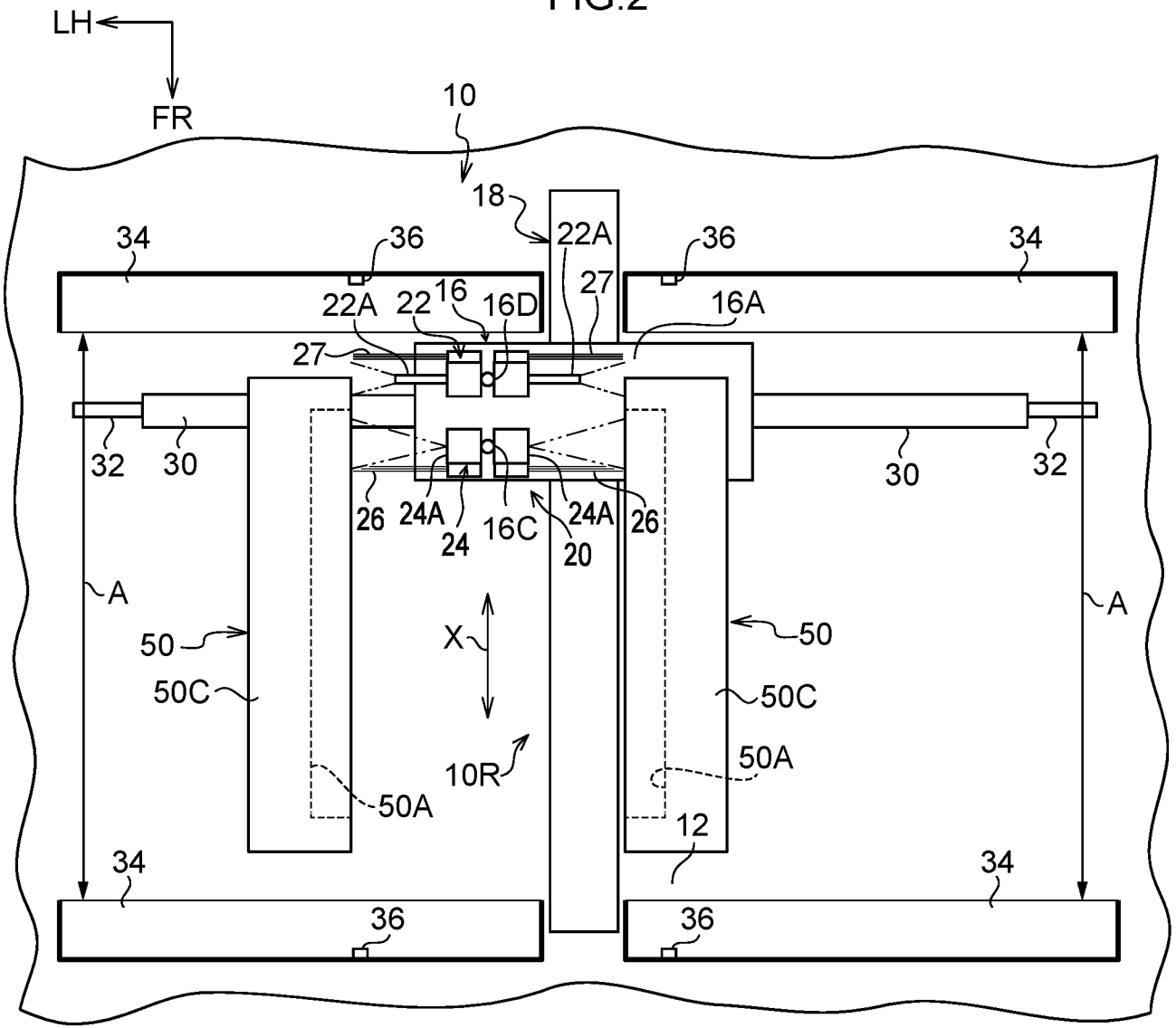
FIG. 2 is a sectional diagram cut along line 2-2 in FIG. 1.
Figure 3:
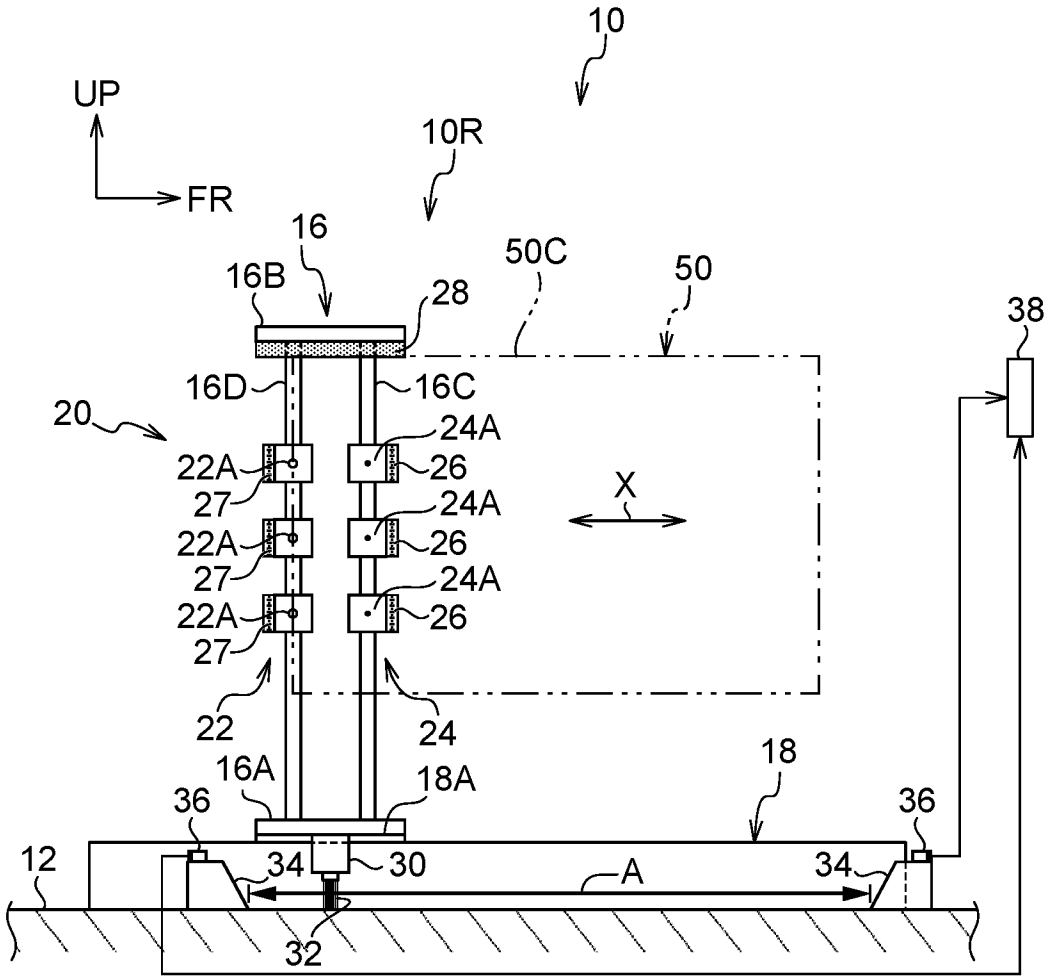
FIG. 3 is a schematic side view showing the mold release agent application device of FIG. 1 in a state seen from a device left side.

A parting agent application device that serves as a die molding surface treatment device according to an exemplary embodiment of the present disclosure is described using FIG. 1 to FIG. 3. An arrow FR that is shown as appropriate in these drawings indicates a near side of a device elevation view, an arrow UP indicates a device upper side, and an arrow LH indicates the left side of the device elevation view.

Structure of the Exemplary Embodiment

FIG. 1 shows a parting agent application device 10 according to the present exemplary embodiment in a schematic elevation view, FIG. 2 shows a view cut along line 2-2 in FIG. 1, and FIG. 3 shows a schematic side view of a state in which the mold release agent application device 10 is seen from the device left side.

As shown in FIG. 1, mold retaining members 14 (which are not shown in the drawings of FIG. 2 and FIG. 3) are provided in a treatment chamber 10R of the mold release agent application device 10. The mold retaining members 14 are for retaining a pair of dies 50. As an example, the pair of dies 50 structure part of a cast molding machine that is used for sand casting-type molding. The pair of dies 50 are supported at a device frame, which is not shown in the drawings, via the mold retaining members 14. In this state, the pair of dies 50 are disposed such that molding surfaces 50A thereof are arrayed in the horizontal direction opposing one another, and downward-facing surfaces 50B are disposed at positions that are separated to the device upper side from a device floor surface 12. A gate portion 50D is formed in each die 50. The gate portion 50D is used for packing of mixed sand (casting sand that has been mixed) into a space inside the die 50 from the side of the die 50 at which an upward-facing surface 50C thereof is disposed. FIG. 3 depicts the mold release agent application device 10 in a state in which the die 50 is transparent; only the exterior shape of the die 50 is shown, by two-dot chain lines.

The device floor surface 12, which is shown in FIG. 1 to FIG. 3, is formed of a material to which mixed sand that falls from the die 50 is unlikely to stick, for example, an ultra-high molecular weight polyethylene. A molecular weight of the ultra-high molecular weight polyethylene is not particularly limited. The molecular weight of the ultra-high molecular weight polyethylene, measured in accordance with ASTM D2857 (viscosity method), is preferably from 1 million to 7 million, more preferably from 3 million to 6.5 million, and even more preferably from 5 million to 6 million. The ultra-high molecular weight polyethylene may be purchased as a commercial product such as, for example, SAXIN NEWLIGHT (registered trademark) from SAXIN CORPORATION. The device floor surface 12 may be formed by adhesive tape, a backplate member or the like being arranged by adhesion at the surface of a device floor portion to prevent adherence (or fixing) of mixed sand and the like.

The mold release agent application device 10 is provided with a moving body 16 that includes a portion disposed between the pair of dies 50 in the state described above. The mold release agent application device 10 is also provided with a driving mechanism 18 that reciprocatingly moves the moving body 16 in a direction (see the direction of arrow X) that is orthogonal to the opposing direction of the pair of dies 50 in the device plan view shown in FIG. 2.

As shown in FIG. 1 to FIG. 3, the driving mechanism 18 is, for example, a publicly known rod and cylinder mechanism, and is disposed on the device floor surface 12. The driving mechanism 18 is disposed so as to pass between the pair of dies 50 in the device plan view shown in FIG. 2 and extend in the directional orthogonal to the opposing direction of the pair of dies 50 (see the direction of arrow X). The driving mechanism 18 is structured such that a moving table 18A, which is shown in FIG. 1 and FIG. 3, reciprocatingly moves in a length direction thereof. The moving table 18A of the driving mechanism 18 is linked from a lower face side thereof to a floor wall portion 16A of the moving body 16.

As shown in FIG. 1 to FIG. 3, the moving body 16 includes the floor wall portion 16A mentioned above, a roof wall portion 16B disposed to oppose a portion at the left side of the floor wall portion 16A from the upper side thereof, and a front and rear pair of linking tube members 16C and 16D that vertically link the floor wall portion 16A with the roof wall portion 16B. As shown in FIG. 3, lengths of the floor wall portion 16A and the roof wall portion 16B in the device front-and-rear direction are specified to be much shorter than lengths of the dies 50 in the device front-and-rear direction. A height position of the roof wall portion 16B is set to a position a little higher than a height position of the upward-facing surface 50C of each die 50. The front and rear pair of linking tube members 16C and 16D are erected so as to vertically pass through the middle between the pair of dies 50 in the device elevation view shown in FIG. 1.

Head portions of a treatment function portion 20 are provided at vertical direction middle portions of the moving body 16. As shown in FIG. 2 and FIG. 3, the treatment function portion 20 is provided with a cleaning blowing function portion 22, head portions of which are provided at a vertical direction middle portion of the linking tube member 16D at the rear side. The treatment function portion 20 is also provided with a parting agent application function portion 24, head portions of which are provided at a vertical direction middle portion of the linking tube member 16C at the front side.

The cleaning blowing function portion 22 is provided with plural blowing nozzles 22A. The blowing nozzles 22A are disposed at both sides in the device left-and-right direction of the linking tube member 16D at the rear side. A plural number of the blowing nozzles 22A (for example, three at each side in the present exemplary embodiment) spaced apart in the vertical direction are disposed at positions corresponding with vertical direction middle portions of the dies 50. Distal ends of the blowing nozzles 22A are oriented to opposite sides thereof from the linking tube member 16D. The blowing nozzles 22A are connected to a compressed air supply mechanism, which is not shown in the drawings, via hoses or the like that are not shown in the drawings. When the compressed air supply mechanism operates, air may be jetted out from the blowing nozzles 22A. Thus, the cleaning blowing function portion 22 performs an air-blowing treatment on the molding surfaces 50A of the pair of dies 50.

As shown in FIG. 1 to FIG. 3, the mold release agent application function portion 24 is provided with plural spraying nozzles 24A. The spraying nozzles 24A are disposed at both sides in the device left-and-right direction of the linking tube member 16C at the front side. A plural number of the spraying nozzles 24A (for example, three at each side in the present exemplary embodiment) spaced apart in the vertical direction are disposed at positions corresponding with the vertical direction middle portions of the dies 50. Distal ends of the spraying nozzles 24A are oriented to opposite sides thereof from the linking tube member 16C. The spraying nozzles 24A are connected to a parting agent supply mechanism, which is not shown in the drawings, via hoses or the like that are not shown in the drawings. When the mold release agent supply mechanism operates, a parting agent may be jetted out (sprayed) from the spraying nozzles 24A. Thus, the mold release agent application function portion 24 performs a treatment of jetting out the mold release agent from the spraying nozzles 24A and applying the mold release agent to the molding surfaces 50A of the pair of dies 50.

As shown in FIG. 2, shielding brushes 26 and 27 (which are not shown in the drawing of FIG. 1) are provided at the moving body 16. Base end sides of the shielding brushes 26 and 27 are attached to both of flank sides of the treatment function portion 20 at the sides of the treatment function portion 20 that oppose the dies 50. The base end sides of the shielding brushes 26 are attached to the flank sides at the opposite side of the spraying nozzles 24A from the side thereof at which the cleaning blowing function portion 22 is disposed. The shielding brushes 26 extend to the sides to which the distal ends of the spraying nozzles 24A are oriented. The base end sides of the shielding brushes 27 are attached to the flank sides at the opposite side of the blowing nozzles 22A from the side thereof at which the mold release agent application function portion 24 is disposed. The shielding brushes 27 extend to the sides to which the distal ends of the blowing nozzles 22A are oriented. The shielding brushes 26 and 27 are specified such that the distal end sides thereof are disposed spaced apart from but close to the dies 50 in states in which the shielding brushes 26 and 27 oppose the dies 50. Because the dies 50 reach high temperatures, the shielding brushes 26 and 27 are formed of materials with high thermal resistance. The shielding brushes 26 and 27 are specified so as to suppress scattering of flying matter that is produced during the treatments by the treatment function portion 20.

As shown in FIG. 1, base end sides of a left and right pair of cleaning brushes 28 are attached to the roof wall portion 16B, at an upper portion of the moving body 16. The cleaning brushes 28 extend towards the sides thereof at which the dies 50 are disposed in the device plan view. Distal end sides of the cleaning brushes 28 touch the upward-facing surfaces 50C of the dies 50. The cleaning brushes 28 are specified so as to reciprocatingly move together with the moving body 16 and sweep the upward-facing surfaces 50C of the dies 50. Lengths of extension of the cleaning brushes 28 may be specified as appropriate. Because the cleaning brushes 28 touch the dies 50 that reach high temperatures, the cleaning brushes 28 are formed of a material with high thermal resistance.

Cleaning brushes 32 that serve as a cleaning implement are attached to the floor wall portion 16A, at a lower portion of the moving body 16, via linking portions 30 at both the left and right sides of the lower face side of the floor wall portion 16A. The cleaning brushes 32 are for cleaning the device floor surface 12. The cleaning brushes 32 are specified such that distal ends of the cleaning brushes 32 are oriented downward and touch the device floor surface 12. Thus, the cleaning brushes 32 are specified so as to reciprocatingly move together with the moving body 16 and sweep the device floor surface 12. The pair of cleaning brushes 32 are disposed at both the left and right sides sandwiching the driving mechanism 18. An end portion of each cleaning brush 32 at the side thereof at which the driving mechanism 18 is disposed is specified to be at a position close to the driving mechanism 18, and an end portion of the cleaning brush 32 at the opposite side from the side at which the driving mechanism 18 is disposed is specified to be further to a device width direction outer side than the corresponding die 50.

As shown in FIG. 2, waste collectors 34 that serve as recovering means (which are not shown in the drawing of FIG. 1) are provided to correspond with positions at both ends of a reciprocating movement range A of the cleaning brushes 32. The waste collectors 34 recover waste matter swept by the cleaning brushes 32. In the present exemplary embodiment, as an example, a total of four of the waste collectors 34 are disposed. As shown in FIG. 3, a level sensor 36 is mounted at an upper portion of each waste collector 34. Each level sensor 36 is a sensor that detects an accumulated height of waste matter recovered and accumulated at the waste collector 34. The level sensor 36 according to the present exemplary embodiment is, for example, a laser-based level sensor that emits laser light to the lower side, receives reflection light that is reflected, and senses an accumulated height of the waste matter. The disposition positions of the level sensors 36 in the device plan view of FIG. 2 illustrate an example.

As shown in FIG. 3, the level sensors 36 are connected to a report display device 38 that serves as reporting means (a component which can be broadly understood as a reporting device, which is not shown in the drawings of FIG. 1 and FIG. 2). The report display device 38 is disposed outside the treatment chamber 10R and is provided with a display portion and a display control portion. The display portion is capable of displaying information in a display area. The display control portion controls the display portion so as to display predetermined information in the display area in accordance with a control program. The report display device 38 is specified such that, when a detection value of the level sensor 36 is at least a pre-specified criterion value, an indication that at least a predetermined amount of waste matter has accumulated is displayed in the display area and reported to a user.

Action, Operation and Effects of the Mold Release Agent Application Device

Now, while the action of the mold release agent application device 10 is described, operation and effects of the present exemplary embodiment are described.

When the molding surfaces 50A of the pair of dies 50 are to be cleaned by air-blowing, while the moving body 16 shown in FIG. 2 is reciprocatingly moved by driving force of the driving mechanism 18, air is blown toward the molding surfaces 50A from the blowing nozzles 22A of the cleaning blowing function portion 22 that constitutes a portion of the treatment function portion 20. When the mold release agent is to be applied to the molding surfaces 50A of the pair of dies 50, while the moving body 16 is reciprocatingly moved by driving force of the driving mechanism 18, the mold release agent is jetted out towards the molding surfaces 50A from the spraying nozzles 24A of the mold release agent application function portion 24 that constitutes a portion of the treatment function portion 20. In the present exemplary embodiment, in both of these situations, the cleaning brushes 32 reciprocatingly move together with the moving body 16 and sweep the device floor surface 12 at the same time as the treatment of the molding surfaces 50A. Therefore, even when waste matter falls onto the device floor surface 12 while the moving body 16 is being reciprocatingly moved and the treatment function portion 20 is operating, the device floor surface 12 is automatically cleaned by the cleaning brushes 32. Therefore, a need for operations of the mold release agent application device 10 to be paused for cleaning by a separate process may be eliminated (or greatly reduced).

In the present exemplary embodiment, because the device floor surface 12 is formed of an ultra-high molecular weight polyethylene, even when waste matter falls onto the device floor surface 12 while the moving body 16 is being reciprocatingly moved and the treatment function portion 20 is operating, the waste matter is unlikely to stick to the device floor surface 12. Hence, the waste matter can be excellently removed by the cleaning brushes 32. Therefore, incidences of, for example, mixed sand that constitutes the waste matter fixing and becoming troublesome to clean off may be avoided or effectively suppressed.

In the present exemplary embodiment, the waste collectors 34 that recover the waste matter swept by the cleaning brushes 32 are provided in correspondence with positions at both ends of the reciprocating movement range A of the cleaning brushes 32. Therefore, waste matter swept by the cleaning brushes 32 is automatically recovered (collected) into the waste collectors 34 at both end sides of the reciprocating movement range A of the cleaning brushes 32. Thus, the waste matter swept by the cleaning brushes 32 may be recovered directly, and the waste matter does not remain on the device floor surface 12 even when the waste matter is not recovered by a separate process.

In the present exemplary embodiment, the level sensor 36 provided at each waste collector 34 detects an accumulated height of the waste matter recovered and accumulated in the waste collector 34. When a detection value of the level sensor 36 is at least the pre-specified criterion value, the report display device 38 shown in FIG. 3 displays and reports that at least the predetermined amount of waste matter has accumulated. Hence, in response to this report, the waste matter may be discharged outside the device by the waste matter being transferred from the waste collectors 34 to a waste collection container outside the device.

In the present exemplary embodiment, when the moving body 16 reciprocatingly moves, the cleaning brushes 28 provided at the upper portion of the moving body 16 sweep the upward-facing surfaces 50C of the dies 50. Thus, the upward-facing surfaces 50C of the dies 50 are cleaned. To add to this description, when mixed sand collects on the upward-facing surfaces 50C of the dies 50, for example, in periphery portions of the upper ends of the gate portions 50D shown in FIG. 1, the mixed sand may be excellently cleaned by the cleaning brushes 28. Waste matter that falls onto the device floor surface 12 when the cleaning brushes 28 sweep the upward-facing surfaces 50C of the dies 50 is swept by the cleaning brushes 32.

In the present exemplary embodiment as shown in FIG. 2, the shielding brushes 26 and 27 provided at the moving body 16 are specified such that the base end sides are attached to both the flank sides at the sides of the treatment function portion 20 that oppose the dies 50, and the distal end sides are disposed spaced apart from but close to the dies 50 in states in which the shielding brushes 26 and 27 oppose the dies 50. Scattering of flying matter that is produced during the treatments by the treatment function portion 20 is suppressed by the shielding brushes 26 and 27. The flying matter that is produced during the treatments by the treatment function portion 20 includes mixed sand that is separated from the molding surfaces 50A of the dies 50 when the cleaning blowing function portion 22 performs the air-blowing treatment, and includes mold release agent that is scattered rather than being applied to the molding surfaces 50A of the dies 50 when the mold release agent application function portion 24 performs the mold release agent application treatment. The mixed sand and mold release agent of which scattering is suppressed by the shielding brushes 26 and 27 and that fall onto the device floor surface 12 are swept by the cleaning brushes 32.

As described above, according to the mold release agent application device 10 according to the present exemplary embodiment, when waste matter falls onto the device floor surface 12 while the device is being operated, the waste matter may be automatically cleaned up while the device is operating.

Supplementary Descriptions of the Exemplary Embodiment

In the exemplary embodiment described above, the treatment function portion 20 is structured to be capable of two treatments, the treatment of air-blowing the molding surfaces 50A of the pair of dies 50 and the treatment of applying a parting agent to the molding surfaces 50A of the pair of dies 50. However, a die molding surface treatment device may be structured with a treatment function portion that performs only one treatment: the treatment of air-blowing molding surfaces (50A) of a pair of dies (50) or the treatment of applying a parting agent to the molding surfaces (50A) of a pair of dies (50).

In the exemplary embodiment described above, the cleaning brushes 32 that serve as the cleaning implement are attached to the lower portion of the moving body 16. However, a cleaning implement attached to a lower portion of the moving body 16 may be a cleaning implement other than cleaning brushes such as, for example, a sponge-form member, a member fabricated of rubber in a long, narrow, thin plate shape, or the like.

In the exemplary embodiment described above, the device floor surface 12 is formed of an ultra-high molecular weight polyethylene. Although this is a preferable constitution, a device floor surface may be formed of an alternative material.

As a variant example of the exemplary embodiment described above, a structure may be employed in which the waste collectors 34 that serve as the recovering means of the exemplary embodiment described above are not provided. In this variant example, waste matter swept by the cleaning brushes 32 (the cleaning implement) is recovered by a separate process.

In the exemplary embodiment described above, the waste collectors 34 are provided as the recovering means. However, recovering means other than waste collectors may be formed such as, for example: a suction device that is capable of sucking waste matter, with suction apertures disposed in correspondence with positions at both ends of the reciprocal movement range (A) of a cleaning implement such as a cleaning brush (32) or the like; holes that are formed penetrating through the device floor portion in correspondence with positions at both ends of the reciprocal movement range (A) of a cleaning implement such as a cleaning brush (32) or the like, and a recovery container that is connected to the holes via recovery hoppers below the holes; or the like. When a main body portion of this suction device is outside a treatment chamber of the die molding surface treatment device, when a structure provided with the holes, the recovery hoppers and the recovery container is provided, or the like, the waste matter swept by the cleaning implement is automatically recovered to outside the treatment chamber of the die molding surface treatment device. Therefore, there is no need to recover waste matter to outside the treatment chamber of the die molding surface treatment device by a separate process.

In the exemplary embodiment described above, each level sensor 36 shown in FIG. 3 is a laser-based level sensor. However, level sensors that are employed may be alternative level sensors such as, for example, ultrasound-based level sensors or the like. Obviously, the number, displacement positions and the like of the level sensors are not limited by the example in the exemplary embodiment described above. Further, in the exemplary embodiment described above, the reporting means is the report display device 38. However, the reporting means may be reporting means other than the report display device 38, such as a report sound emission device (a component which can be broadly understood as a reporting device) that, when a detection value of a level sensor (36) is at least a pre-specified criterion value, reports that at least a predetermined amount of waste matter has been collected by a voice message or a warning sound, or the like. As a variant example of the exemplary embodiment described above, a structure may be employed that is not provided with the level sensors 36 and the report display device 38 serving as the reporting means.

As an alternative variant example of the exemplary embodiment described above, a structure may be employed in which the cleaning brushes 28 are not provided for cleaning the upward-facing surfaces 50C of the dies 50. In the exemplary embodiment described above, the shielding brushes 26 and 27 are provided at the moving body 16 of the mold release agent application device 10 in which the treatment function portion 20 shown in FIG. 2 is equipped with the cleaning blowing function portion 22 and the mold release agent application function portion 24. However, shielding brushes provided at a moving body (16) may also be employed when a treatment function portion is structured only with a cleaning blowing function portion (22), and may be employed when a treatment function portion is structured only with a parting agent application function portion (24). To add to this description, both when a treatment function portion is structured only with a cleaning blowing function portion (22) and when a treatment function portion is structured only with a parting agent application function portion (24), a structure may be employed in which base end sides of shielding brushes that are substantially the same as the shielding brushes 26 and 27 of the exemplary embodiment described above are provided at both flank sides at the sides of the treatment function portion that oppose dies (50). As a further alternative variant example of the exemplary embodiment described above, a structure may be employed in which the shielding brushes 26 and 27 are not provided.

Structural portions for performing the treatment of applying a parting agent to the molding surfaces (50A) of a pair of dies (50) may be, for example, structural portions that do not include spraying nozzles (24A) but include alternative applying means such as application rollers or the like.

The exemplary embodiment described above and the variant examples mentioned above may be embodied in suitable combinations.

Hereabove, examples of the present disclosure have been described. The present disclosure is not limited by these descriptions and it will be clear that numerous modifications beyond these descriptions may be embodied within a technical scope not departing from the gist of the invention.

The disclosures of Japanese Patent Application No. 2018-131031 filed Jul. 10, 2018 are incorporated into the present specification by reference in their entirety.

The invention claimed is:

1. A die molding surface treatment device comprising:

a moving body including a portion that is disposed between a pair of dies that are arrayed in a horizontal direction, with molding surfaces of the dies opposing one another;

a driving mechanism that reciprocatingly moves the moving body in a direction that is orthogonal to an opposing direction of the pair of dies in a device plan view and that is along a device floor surface;

a treatment function portion provided at the moving body, the treatment function portion performing at least one of a treatment of air-blowing the molding surfaces of the pair of dies or a treatment of applying a parting agent to the molding surfaces of the pair of dies; and a cleaning implement attached to a lower portion of the moving body, the cleaning implement reciprocatingly moving together with the moving body and sweeping the device floor surface.

2. The die molding surface treatment device according to claim 1, wherein the device floor surface is constituted from an ultra-high molecular weight polyethylene.

3. The die molding surface treatment device according to claim 1, wherein a recovering means is provided in correspondence with positions at both ends of a reciprocating movement range of the cleaning implement, the recovering means recovering waste matter swept by the cleaning implement.

4. The die molding surface treatment device according to claim 3, further comprising:

a waste collector that serves as the recovering means;

a level sensor provided at the waste collector, the level sensor detecting an accumulated height of waste matter recovered and accumulated at the waste collector; and a reporting means that, in a case in which a detection value of the level sensor is at least a pre-specified criterion value, reports that at least a predetermined amount of the waste matter has been accumulated.

5. The die molding surface treatment device according to claim 1, further comprising a cleaning brush attached to an upper portion of the moving body, the cleaning brush reciprocatingly moving together with the moving body and sweeping an upward-facing surface of the dies.

6. The die molding surface treatment device according to claim 1, further comprising shielding brushes provided at the moving body, base end sides of the shielding brushes being attached at both flank sides of the treatment function portion at sides of the treatment function portion that oppose the dies, and distal end sides of the shielding brushes being disposed spaced apart from but close to the dies in a state in which the shielding brushes oppose the dies, the shielding brushes suppressing scattering of flying matter that is produced during a treatment by the treatment function portion.

* * * * *